United States Patent [19]

Francis

[11] 4,237,622

[45] Dec. 9, 1980

[54] DRYER USING VIBRATORY FEEDING

[76] Inventor: Theodore R. Francis, 511 S. Shore Dr., Fontana, Wis. 53125

[21] Appl. No.: 974,526

[22] Filed: Dec. 29, 1978

[51] Int. Cl.[3] ..... F26B 15/26

[52] U.S. Cl. ..... 34/147; 34/164; 34/171

[58] Field of Search ..... 34/57 R, 57 B, 57 C, 34/147, 164, 168, 171, 174, 178, 184, 187

[56] References Cited

U.S. PATENT DOCUMENTS

| | | | |
|---|---|---|---|
| 375,920 | 1/1888 | Bradley | 34/147 |
| 2,794,266 | 6/1957 | Bradfield | 34/147 |
| 2,983,051 | 5/1961 | Zimmermann et al. | 34/164 |
| 3,343,812 | 9/1967 | Moulton | 34/147 X |
| 3,512,267 | 5/1970 | Eichholz et al. | 34/164 X |
| 3,742,614 | 7/1973 | Bettermann et al. | 34/147 |

FOREIGN PATENT DOCUMENTS

| | | | |
|---|---|---|---|
| 857 | of 1863 | United Kingdom | 34/147 |
| 394639 | 12/1973 | U.S.S.R. | 34/164 |

*Primary Examiner*—Albert J. Makay
*Assistant Examiner*—Harold Joyce
*Attorney, Agent, or Firm*—George H. Gerstman

[57] ABSTRACT

An industrial dryer particularly suited for small parts has a tub to contain the parts and a helical ramp along the interior tub wall. Vibratory motion makes the small parts move along the ramp. The tub has a double wall, the inside space between the walls defining an air plenum. The interior wall of the tub is formed with exit spaces through which the hot air emerges and blows over the parts as they move along the ramp. The plenum is continuously supplied with hot air to replace the losses. A unique method of forming the ramp from stair-step segments and partitions forms special conduits which focus hot air streams upon the parts as they move along the ramp in staircase fashion.

5 Claims, 8 Drawing Figures

DRYER USING VIBRATORY FEEDING

BACKGROUND OF THE INVENTION

This invention concerns drying apparatus, and more particularly, a dryer of the type which employs vibratory motion for conveying the items to be dried.

A common type of industrial dryer employs a porous screen conveyor to carry small parts past a drying station where hot air is blown through the porous screen. In such dryers, vibratory energy is often used to tumble the parts on the conveyor.

Another type of dryer, exemplified by the common home laundry dryer, also utilizes a tumbling motion to achieve more efficient drying. There the tumbling is achieved by rotating a perforated drum about a horizontal axis, and the drying section is achieved by passing hot air through the perforations in the drum. Both these types or dryers can cause difficulties when small mechanical parts or bulk materials are to be dried, because the parts can sometimes tumble into attitudes which cause various projections to become caught or fall through the perforations of the conveyor screen or drum. Dryers with unperforated belt conveyors avoid this problem, but they do not have any means for fully exposing the parts; therefore, it takes longer for the hidden surfaces of the parts to dry. Dryers with worm-type tumbling systems are also fairly slow.

SUMMARY OF THE INVENTION

The present invention achieves rapid drying by tumbling and forcing gas, such as air, through the parts, yet avoids the problem of small parts getting caught in the perforations of conveyor screens or rotating drums. It accomplishes this by providing a gas plenum which is enclosed by a double wall. The double wall preferably is arranged in an annular geometry to form an enclosed tub for containing the small parts, although it is also possible to employ a linear geometry if a separate hopper for the small parts is provided. In either case, a plurality of ramp segments is mounted upon a surface of one of the plenum walls. The ramp segments are arranged in sequence to form a continuous length of ramp along the surface of the wall.

In the illustrative embodiment, consecutive ramp segments in the sequence are spaced from each other at successively higher levels, so that the ramp gradually traverses the plenum wall. The adjacent ends of each pair of consecutive ramp segments overlap, thereby defining gas conduit spaces between them. The adjacent plenum wall is formed with gas exit openings which admit the contents of the plenum into these conduits. Partitions are positioned between pairs of consecutive ramp segments to deflect the gas, so that it exits from the conduits toward the upper surface of the lower ramp segment.

A vibratory mechanism is provided, which causes small parts to tumble down the ramp, moving in stair-step fashion from each higher ramp segment to each underlapping lower ramp segment. As they do so, the wet parts are exposed directly to a stream of gas emerging from the conduit spaces between the upper and lower ramp segments, while at the same time they tumble to expose different wet surfaces. The gas is thus forced completely through the parts or material to be dried.

A dryer constructed according to the above principle has been found to dry rapidly and effectively, without the risk of small parts becoming caught in or falling through the apparatus.

These and additional features of the invention will be more fully appreciated from the following drawings and detailed description of a preferred embodiment.

DETAILED DESCRIPTION OF THE ILLUSTRATIVE EMBODIMENT

Figure 1:
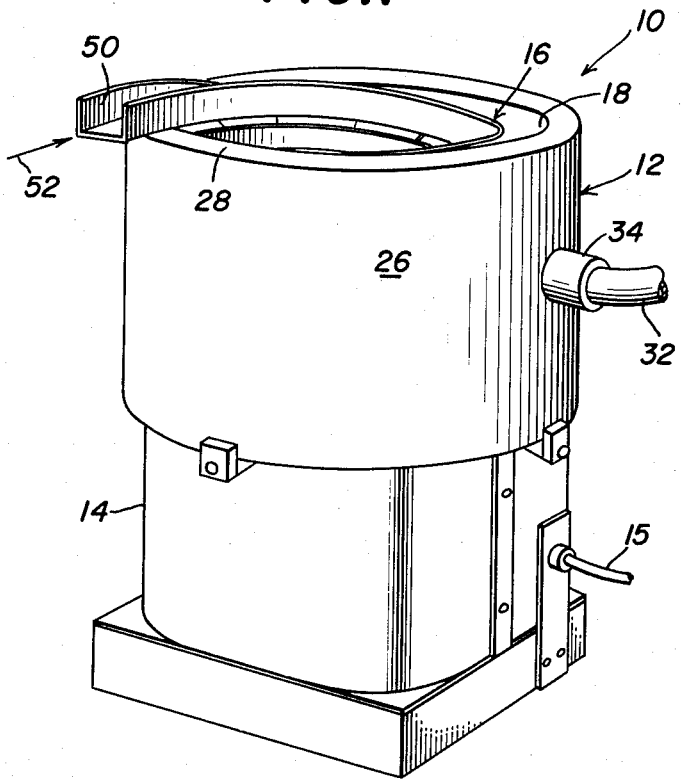
FIG. 1 is a perspective view of the dryer of this invention.

The dryer 10 of this invention comprises a tub 12 for containing and drying small mechanical parts. The tub 12 is mounted upon a vibrating base 14 driven by an electric motor (not shown) supplied by power line 15. Such vibratory mechanisms are conventional, and have long been in use for conveying and tumbling small parts for a variety of purposes. U.S. Pat. No. 3,700,068, for example, shows a vibratory small parts feeder mechanism of the type employed herein. One of the properties of such mechanisms is that they have the capability of driving small parts up or down an incline and even up or down a series of low stair-steps. In the context of the present invention, this ability is exploited for driving the small parts in the tub 12 down a helical ramp 16 which winds downwardly across the interior wall 18 of tub 12.

Figure 7:
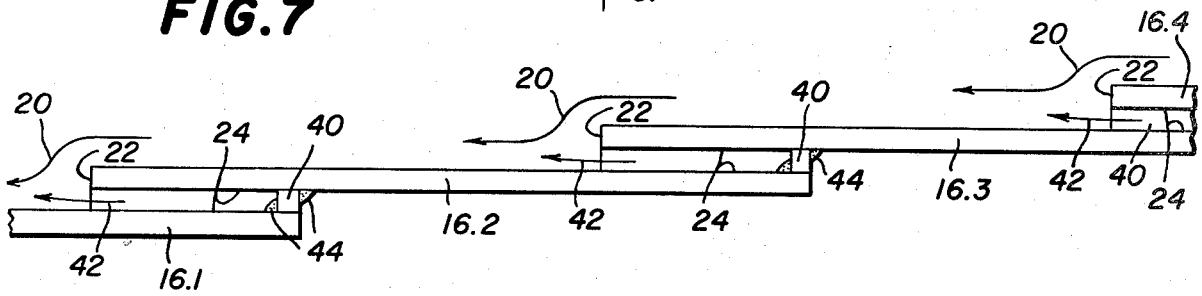
FIG. 7 is a fragmentary section taken along the curved lines 7—7 of FIG. 6, looking in the direction of the arrows.
Figure 8:
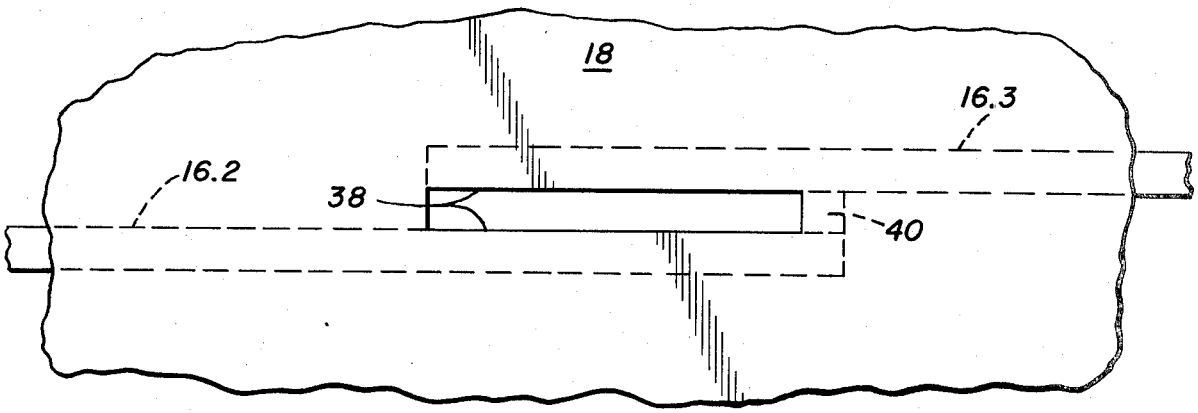
FIG. 8 is a fragmentary section taken along the curved lines 8—8 of FIG. 6, looking in the direction of the arrows.

As best seen in FIG. 7, the ramp 16 consists of a series of consecutive segments, such as those designated 16.1, 16.2, 16.3 and 16.4. Each pair of consecutive segments (e.g., segments 16.1 and 16.2, or segments 16.2 and 16.3) are spaced vertically apart, the preceding segment (such as 16.3) always being higher than the succeeding segment (such as 16.2). The terms "preceding" and "succeeding" here refer to the direction of small part movement, indicated by arrows 20. In addition, the adjacent ends of each pair of consecutive segments (for example, with respect to the direction of small part motion indicated by arrows 20, the downstream end of segment 16.2 and the upstream end of segment 16.1) overlap each other for a short distance, so that a low series of stair-steps 22 is formed, which the small parts in the tub 12 must tumble down (see arrows 20 in FIG. 7) as they descend the helical ramp 16 under the influence of the vibratory mechanism 14. The vertical space 24 between each pair of overlapping ramp segment ends forms a conduit for conducting a drying gas, such as forced hot air. The gas exits from the conduits 24 and flows over the small parts as they descend each stair-step 22.

Figure 3:
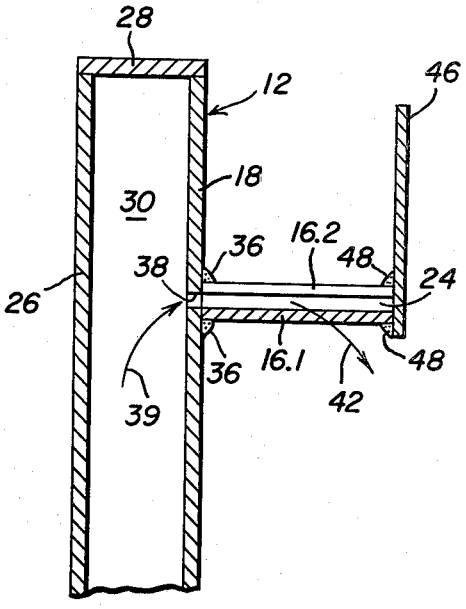
FIG. 3 is a fragmentary section taken along the lines 3—3 of FIG. 2, looking in the direction of the arrows.
Figure 2:
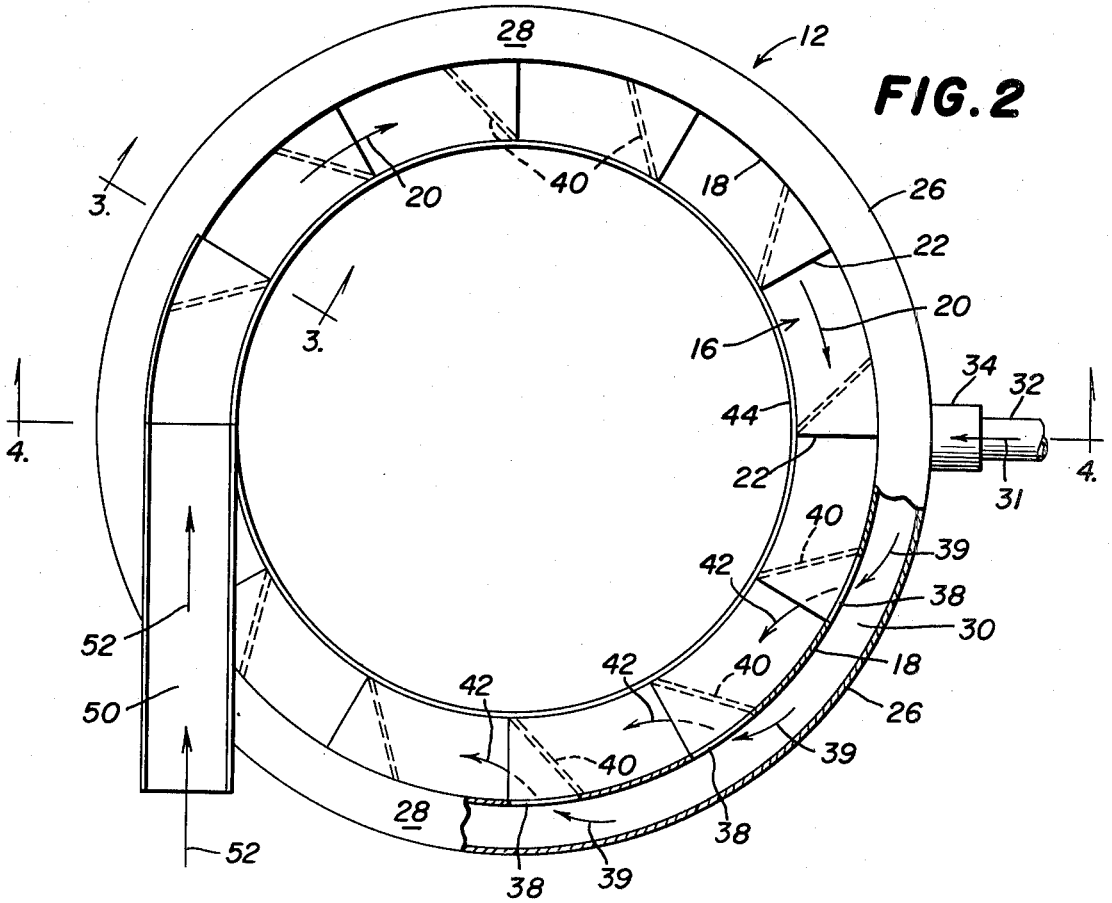
FIG. 2 is a top plan view of the dryer.
Figure 4:
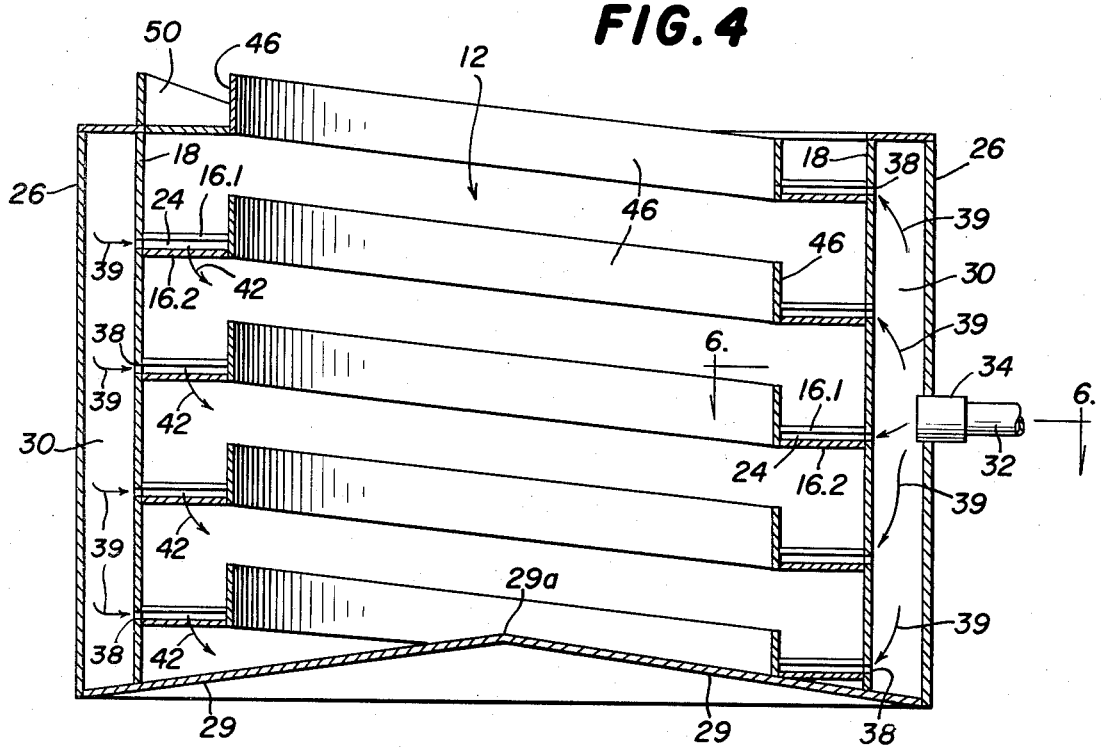
FIG. 4 is a sectional view of the tub assembly on the dryer, taken along the lines 4—4 of FIG. 2, looking in the direction of the arrows.
Figure 5:
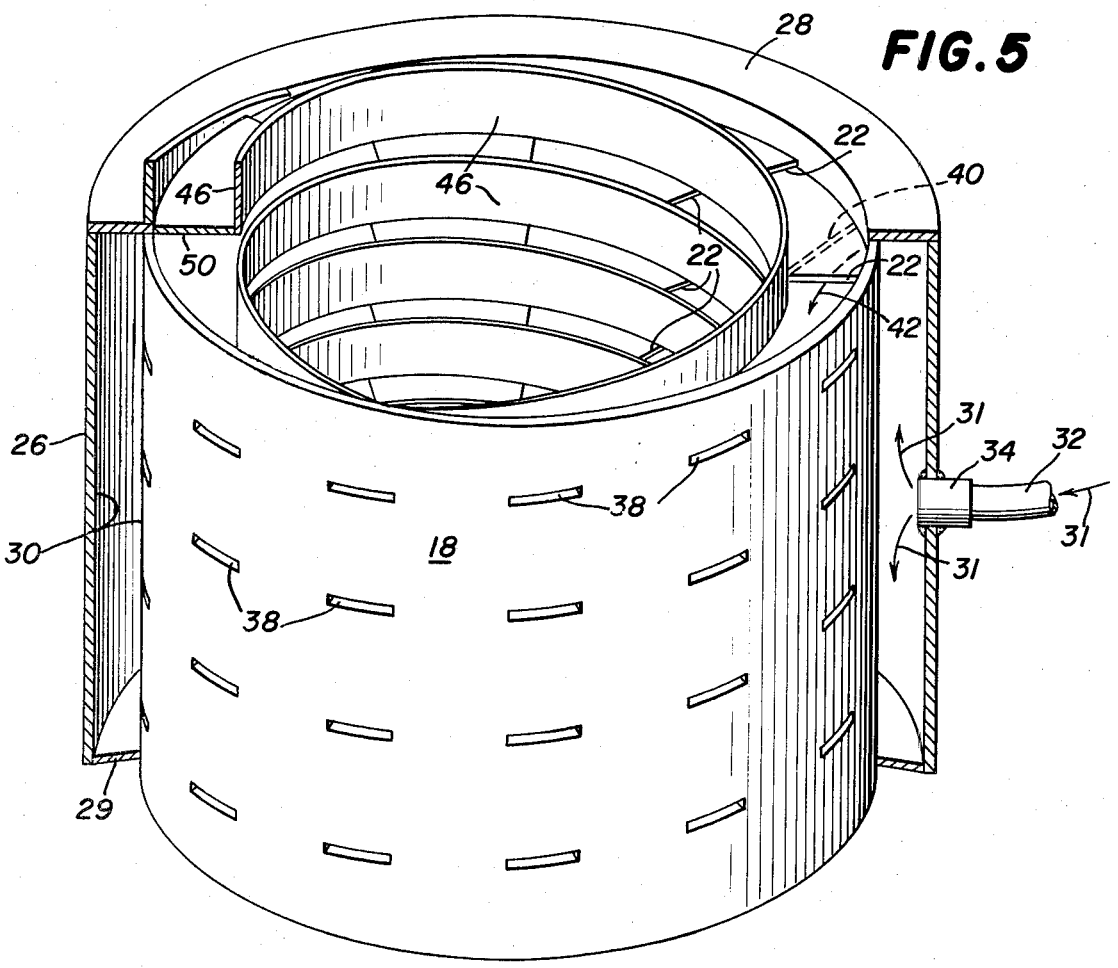
FIG. 5 is a perspective view of the tub assembly, with parts broken away to reveal details of internal construction.
Figure 6:
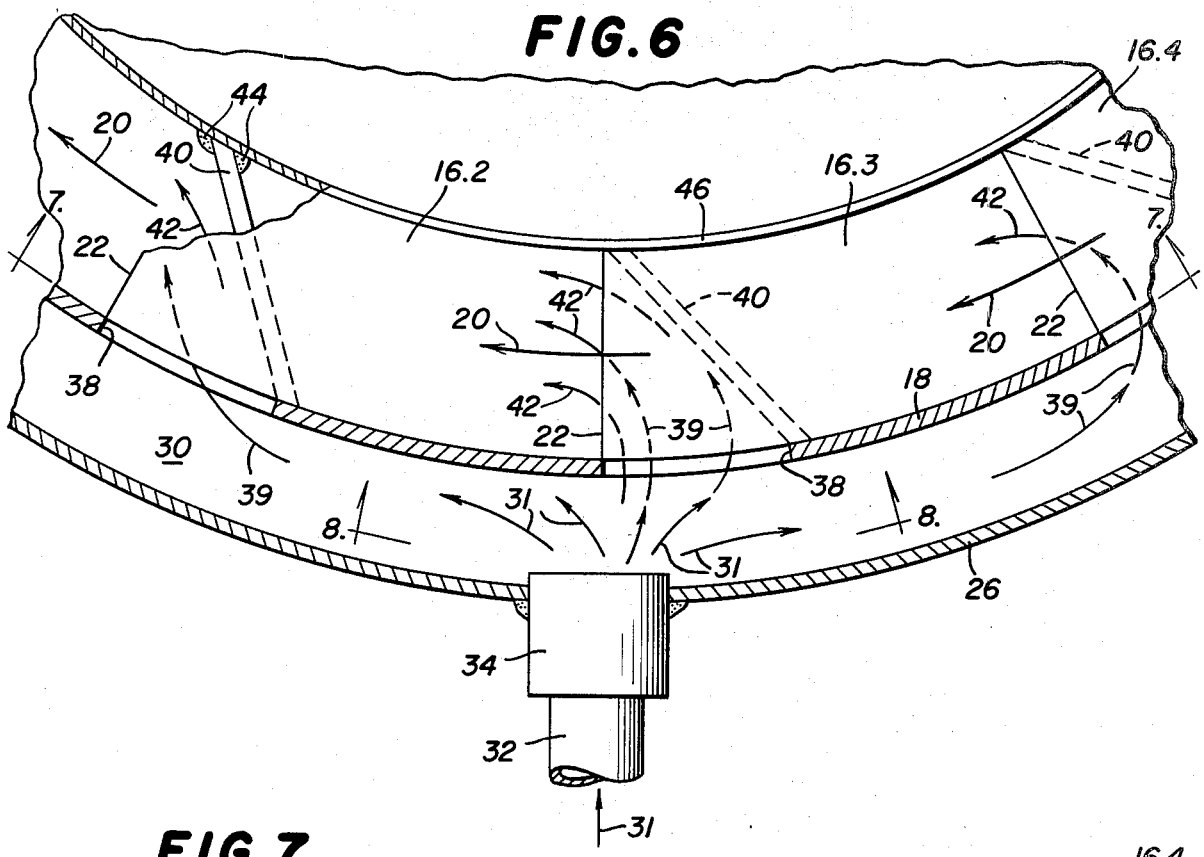
FIG. 6 is a fragmentary section taken along the lines 6—6 of FIG. 4, looking in the direction of the arrows.

As best seen in FIG. 3, the tub 12 is bounded by double walls 18, 26. These double walls, in cooperation with a top wall 28 and bottom wall 29, enclose an internal gas plenum 30 which is filled with heated air under pressure continuously entering (as indicated by arrows 31) through a hose 32 and fitting 34. Any conventional heater and air pump (not shown) of adequate capacity may be employed to supply hot air to the plenum 30.

The ramp segments 16.1, 16.2, etc. project radially inwardly toward the axis of the tub 12 from the interior wall 18, and are preferably secured thereto by welding (note weld beads 36 visible in FIG. 3). The conduit spaces 24 formed between the lapping ends of each pair of adjacent ramp segments (e.g., segments 16.1 and 16.2 in FIG. 3) communicate with the hot air plenum 30 by means of respective exit openings 38 (FIGS. 3, 5, 6 and 8) formed at appropriate places in the inside wall 18 of tub 12. Through these exit openings 38 the pressurized hot air in the plenum 30 rushes out into the conduit spaces 24, as indicated by arrows 39. There it is deflected by partitions 40, which are angularly oriented to force the hot air to exit from the conduit spaces 24 in the direction indicated by arrows 42; that is, substantially the direction of movement of the small parts indicated by arrows 20. Thus, as the small parts move downwardly over a stair step 22, simultaneously tumbling to expose successively different wet surfaces, a stream of hot, drying air under pressure issues from the open mouth of the adjacent conduit space 24 (which is located between the upper and lower "stair treads" or ramp segments, e.g., 16.2 and 16.3, just where the "riser" would be if this were a true stair step); and this steam of hot air blows over all the successively exposed wet surfaces of the tumbling small parts as they descend step 22, and again and again as they descend each successive step 22, always tumbling randomly for maximum surface exposure.

This produces an impressively rapid and effective drying action; yet there is no danger that the small parts will become caught in the conduit spaces 24, because the stream of hot air is issuing outwardly in the direction of movement of the parts and the mouth of each conduit space 24 faces horizontally instead of vertically. Therefore, there is no tendency for the small parts to push any of their still smaller projections into the conduit spaces 24 with sufficient force to become jammed or caught therein. The conduit spaces 24 may be small enough in the vertical dimension to prevent an entire part from falling in, and the same precaution had also been taken in the past in designating the prior art equipment utilizing porous conveyor screens and perforated drums for tumble-drying. In the case of such prior art equipment, however, while such precautions were effective in preventing the entire part from falling through the screen porosities or the drum perforations, they often were ineffective in preventing the still smaller projections formed on the parts from extending into these porosities or perforations with enough force to become jammed or caught therein; because the downward force of gravity always pulls the small parts toward the porous screen below them or toward the lowermost perforations of the tumbling drum at each phase of its rotation. This problem is entirely avoided by the present invention.

Noting some further details of construction, the partitions 40 are preferably welded by means of beads 44 (see FIGS. 6 and 7) to their associated upper and lower ramp segments 16.1, 16.2, 16.3, etc. To keep the small parts from falling off the sides of the ramp 16, i.e., radially toward the center of tub 12, a helical guard rail 46 is welded (see beads 48 in FIG. 3) to the radially inner edge of all the ramp segments 16.1, 16.2, etc., thus forming a U-shaped channel to retain the small parts as they descend the ramp 16. At the lower, or exit, end of the helical ramp 16, a final exit channel may carry the moving small parts out of the tub 12 for delivery to some suitable next stage of processing.

This arrangement lends itself readily to a continuous, as opposed to a batch type, drying process. A supply of wet parts may be introduced to the upper end of the ramp 16 at channel 50. All that is necessary to keep the process going without interruption is to add more wet parts occasionally by introducing them into the open channel 50. This is a significant advantage over the rotating drum type of tumble dryer, which can only be operated on a batch basis.

It will now be fully appreciated that this invention is exceptionally effective in drying small parts, because of the manner in which these parts are repeatedly tumbled through directed streams of hot air, yet the danger of such parts becoming jammed or caught in the exit openings provided for the drying gas is sharply reduced.

The dryer of the present invention can be used for drying all types of parts, including sorted industrial parts, unsorted variable size parts, unsorted variable size granular items, chemical matter, food items, granular matter, and all other types of parts which require drying.

The segments may be oriented in various ways with respect to the plenum. For example, the parts may enter a tub at the bottom center, move up along the inside of the tub, over the top of the tub, down on the outside and exit from the lower outside surface of the tub. As an alternative, the parts may enter at the bottom on the outside of the tub, move up along the outside of the tub, over the top of the tub, move down along the inside of the tub and exit from the inside bottom of a tub. Alternatively, the parts may enter the bottom inside of the tub, move up along the inside of the tub and exit at the top of the tub. Still further, as illustrated herein, the parts may enter at the top of the inside of the tub, move down on the inside of the tub and exit at the bottom of the inside of the tub. Alternatively, the parts may enter at the bottom of the outside of the tub, move up along the outside of the tub and exit at the top of the outside of the tub. Further, the parts may enter at the top on the outside of the tub, move down along the outside of the tub, and exit at the bottom of the outside of the tub. The ramp segments may form a spiral as illustrated, or may be linear or may form any other configuration which provides a satisfactory dyring and moving system.

The foregoing is merely an illustrative embodiment of the invention, the essential principles thereof being more generally stated in the appended claims.

What is claimed is:

1. A dryer comprising walls defining a gas plenum, means for supplying a continuous flow of a drying gas to said plenum, a plurality of ramp segments mounted upon a surface of a wall of said plenum and arranged in sequence to form a continuous length of ramp traversing said plenum wall, consecutive ramp segments in said sequence being spaced from each other at successively higher levels whereby said continuous length of ramp ascends said plenum wall, pairs of consecutive ramp segments overlapping at their adjacent ends whereby to define respective drying gas conduits in said spaces between the overlapping portions of the higher and lower ramp segments of such pairs, respective exit openings formed in said plenum wall for admitting said drying gas from said plenum into said conduits, respective partition means positioned between pairs of consecutive ramp segments to deflect said drying gas so that it emerges from said conduits toward the upper surface of the lower ramp segments of such pairs, means for vibrating said ascending length of ramp so that wet items placed thereon will continuously move along said ramp and will thereby be presented in varying attitudes to streams of drying gas issuing from successive conduits when said items are about to move to a different ramp segment, said plenum walls being annularly curved to form an enclosure for said wet items, and said length of ramp being helically disposed upon the wall of said plenum which is inside said enclosure.

2. A dryer as in claim 1, further comprising side guard rail means disposed at the edges of said ramp segments distal from said plenum wall to prevent said items from falling off said ramp.

3. A dryer comprising a tub for containing wet items, said tub having a double wall, said walls defining therebetween a gas plenum, a plurality of ramp segments mounted upon a wall of said tub and arranged in sequence to form a continuous length of ramp along said tub wall, consecutive ramp segments in said sequence being spaced from each other at successively higher levels whereby said length of ramp helically ascends said tub wall, pairs of consecutive ramp segments overlapping at their adjacent ends whereby to define respective drying gas conduits in said spaces between the overlapping portions of the higher and lower ramp segments of such pairs, respective exit openings formed in said tub wall for admitting drying gas from said plenum into said conduits, respective partition means positioned between pairs of consecutive ramp segments to deflect said drying gas so that it emerges from said conduits toward the upper surface of the lower ramp segments of such pairs, and means for vibrating said tub so that wet items placed in said tub will continuously move along said length of ramp and will thereby be presented to streams of drying gas issuing from successive conduits when said items are about to move to a different ramp segment.

4. A dryer as in claim 3, further comprising exit means at one end of said ramp for conducting said items out of said tub.

5. A dryer comprising walls defining a gas plenum, a spiral ramp mounted upon a surface of a wall of said plenum, said plenum defining openings in communication with said ramp, said spiral ramp comprising a plurality of ramp segments with consecutive ramp segments being spaced from each other at successive levels, each pair of consecutive ramp segments overlapping at their adjacent ends above and below one of said openings, angled partition means positioned between pairs of consecutive ramp segments at an acute angle with respect to said openings to deflect the drying gas that exits from the plenum through said openings so that the drying gas is deflected at an acute angle by the angled partition means to emerge toward the upper surface of the lower ramp segment of each pair, and means for vibrating said ramp whereby parts to be dried will move along the ramp and be contacted by gas from said plenum passing through said openings and deflected at an acute angle by the angled partition means.

* * * * *